US007373705B2

(12) United States Patent
Jean et al.

(10) Patent No.: US 7,373,705 B2
(45) Date of Patent: May 20, 2008

(54) METHOD AND AN INSTALLATION FOR NEEDLING A FIBRE FLEECE USING TWO NEEDLE BARS

(75) Inventors: Robert Jean, Fouqueville (FR); Francois Louis, La Saussaye (FR)

(73) Assignee: Asselin-Thibeau, Tourcoing (FR)

( * ) Notice: Subject to any disclaimer, the term of this patent is extended or adjusted under 35 U.S.C. 154(b) by 277 days.

(21) Appl. No.: 11/218,628

(22) Filed: Sep. 6, 2005

(65) Prior Publication Data

US 2006/0288549 A1 Dec. 28, 2006

(30) Foreign Application Priority Data

Jun. 22, 2005 (FR) ..... 05 06300

(51) Int. Cl.
*D04H 18/00* (2006.01)

(52) U.S. Cl. ..... 28/113; 28/114

(58) Field of Classification Search ..... 112/80.4, 112/80.42, 80.41
See application file for complete search history.

(56) References Cited

U.S. PATENT DOCUMENTS 1,742,133 A * 12/1929 Chase ..... 28/113
3,602,967 A * 9/1971 Zocher et al. ..... 28/111
3,909,891 A * 10/1975 Dilo ..... 28/109
4,035,881 A * 7/1977 Zocher ..... 28/111
4,891,870 A * 1/1990 Muller ..... 28/107
5,548,881 A 8/1996 Ludwig
5,636,420 A 6/1997 Jourde et al.
5,732,453 A 3/1998 Dilo et al.
5,873,152 A * 2/1999 Jourde et al. ..... 28/107
5,909,883 A * 6/1999 Jourde et al. ..... 28/114
6,158,097 A * 12/2000 Dilo ..... 28/114
6,161,269 A 12/2000 Dilo et al.
6,748,633 B2 6/2004 Legl et al.
6,785,940 B1 9/2004 Muller

FOREIGN PATENT DOCUMENTS

| | | |
|---|---|---|
| DE | 1 803 342 | 5/1970 |
| EP | 0 892 102 | 1/1999 |
| FR | 2180928 | 11/1973 |

* cited by examiner

*Primary Examiner*—Amy B. Vanatta
(74) *Attorney, Agent, or Firm*—Young & Thompson

(57) ABSTRACT

The installation includes two needling apparatuses (2, 3) which succeed each other on one side of the path (1) for the fleece to be needled. The needles (47) have an "elliptical" movement, i.e. their reciprocating movement of penetration is combined with a reciprocating movement parallel to the direction of progression. The two mechanisms are actuated at the same speed but with a phase shift of 180° between them. The installation is used for balancing horizontal vibrations.

23 Claims, 3 Drawing Sheets

METHOD AND AN INSTALLATION FOR NEEDLING A FIBRE FLEECE USING TWO NEEDLE BARS

BACKGROUND OF THE INVENTION

This invention relates to a method and an installation for needling a fibre fleece using at least two needle bars placed successively on the path of the fleece, wherein the first of the needle bars may be more particularly but not limitatively intended to carry out a pre-needling step.

More specifically, the invention relates to a needling system in which the needle bars are operated with an "elliptical"-type movement, i.e. having a reciprocating penetration movement component, typically vertical, and a reciprocating progressive movement component, typically horizontal.

The progression component is synchronized with the penetration component in such a way that the needles in penetration position in the fleece accompany the progressive movement of the fleece through the needle loom. Thus, the needles can help to drive the fleece through the needle loom. Moreover, it is no longer necessary to stop the progression of the fleece when the needles are in their penetration phase.

On the other hand, the progression component constitutes an additional alternating movement affecting in particular the movable structure carrying the needle bar. Given the weight of this assembly, this results in vibrations parallel to the direction of progression, in particular at the high strike rates currently required by the users.

It is, admittedly, known to compensate for the effects of the vibrations by suitably orientated rotating counterweights, or by other means. But these compensation means are imperfect, heavy and expensive.

SUMMARY OF THE INVENTION

The object of this invention is to propose a needling method and an installation in which the vibrations, in particular in the direction of progression, are damped, even at a high strike rate.

According to a first aspect of the invention, the method of needling a fibre fleece in at least two successive needling apparatuses each comprising a movable structure carrying needles and to which a movement is imparted having, in the needles, a reciprocating component of penetration into the fleece and a reciprocating progression component, is characterized in that the two needling apparatuses are actuated with a phase shift between them such that the reciprocating progression components of the two movable structures are substantially in opposite directions.

Thus, the progressive movements of the two movable structures mutually balance, at least partially, their own inertias and the total vibration of the installation is at least greatly reduced. The need to provide two successive needling apparatuses is not a constraint as this is in any case very often necessary in order to ensure the required needling density and the required production speed.

According to a second aspect of the invention, the needling installation comprising two successive needling apparatuses along a path of a fleece to be needled and which each comprise a movable structure intended to carry needles and an actuating mechanism applying to the movable structure a movement having, in the needles, a reciprocating component of penetration and a reciprocating progression component, is characterized in that the two actuating mechanisms are capable of an identical rate with a phase shift between them such that the reciprocating progression components of the two movable structures are substantially in opposite directions.

One of the components, preferably the progression component, is preferably at least to a large extent generated by an angular oscillation of the movable structure.

This type of needling apparatus does not necessarily comprise a crank connecting-rod mechanism in alignment with the chief masses which are in alternating movement according to the progression component. Moreover, as the movable structure oscillates angularly, the component parallel to the direction of progression of the fleece is not the same in all the planes parallel to the fleece. Certain vibrations have a frequency which is double the strike frequency of the needling apparatus. For all these reasons, it is difficult to use counterweights for balancing the horizontal vibrations of such a needling installation which is, however, otherwise very advantageous. The invention, on the other hand, provides a very efficient solution resulting in a virtually plane-by-plane balancing.

BRIEF DESCRIPTION OF DRAWINGS

Other features and advantages of the invention will also emerge from the following description, given non-limitatively.

In the attached drawings.

DETAILED DESCRIPTION OF THE PREFERRED EMBODIMENTS

Figure 1:
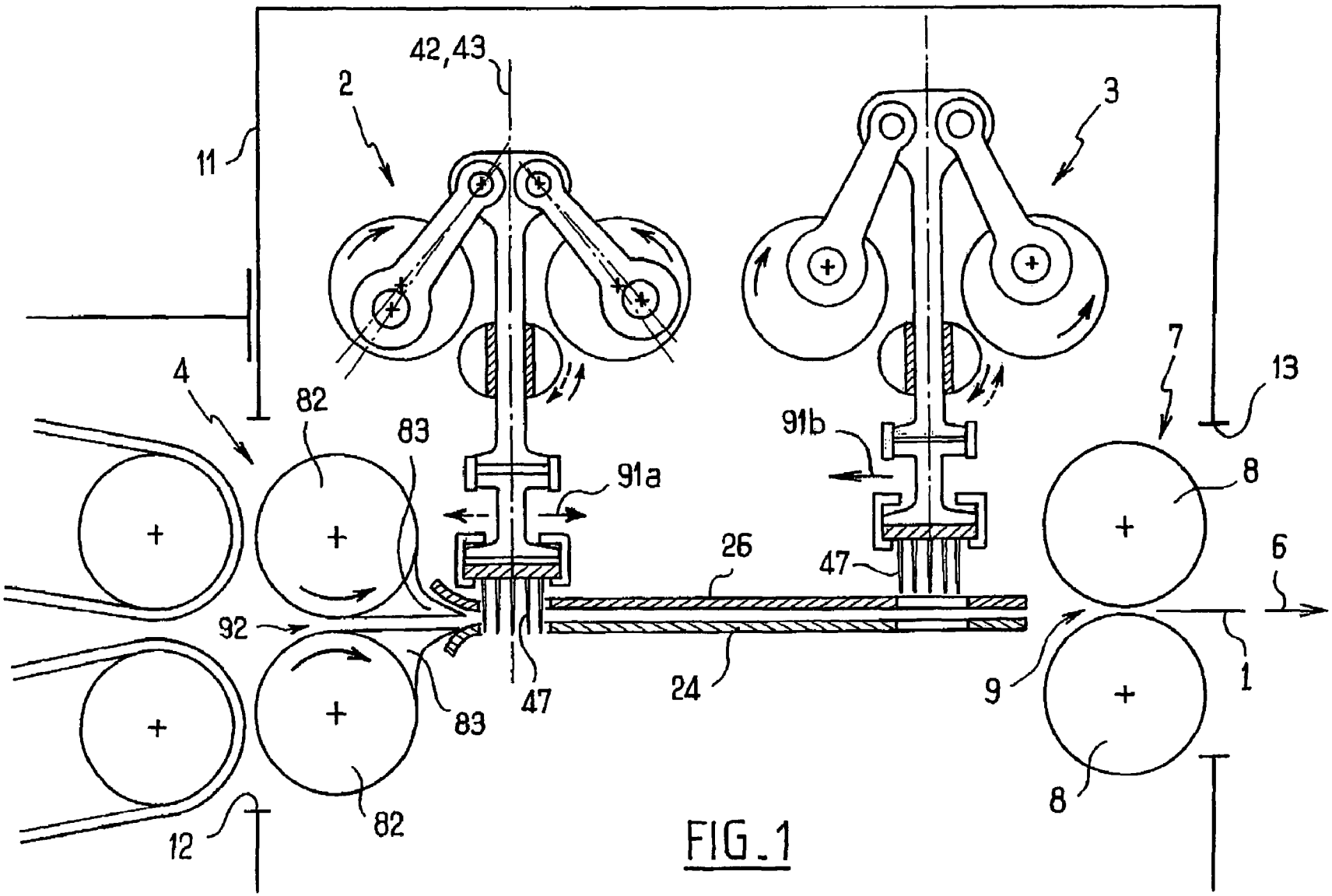
FIG. 1 is a diagrammatic view of an example illustrating a needling installation implementing the method according to the invention where the two needling apparatuses are in maximum-penetration and maximum-withdrawal position respectively.

In the example shown in FIG. 1, the installation comprises two needling apparatuses 2 and 3 which succeed each other along a path 1 for a fibre fleece (not shown in FIG. 1). A feed apparatus 4 is also provided upstream of the needling apparatus 2 relative to the direction 6 of progression of the fleece, and an extractor apparatus 7 situated downstream of the needling apparatus 3 and constituted by two rotating rollers 8 defining between them a pinch line 9 for the fleece along the path 1 which is substantially plane. The feed apparatus 4 comprises two cylinders constituted by rotating discs 82 defining between them a pinch line 92. Stationary rings extended by guide noses 83 for the fleece are inserted between the rotating discs 82 of the same roller.

In the following, "distal" and "proximal" respectively mean "relatively remote from" and "relatively close to" the plane of the path 1.

The needling apparatuses 3 and 2 are jointly housed in a single box 11 and thus form part of the same machine. The box 11 has an entry window 12 in which the feed apparatus 4 is installed and an exit window 13 in which the extractor apparatus 7 is installed.

Between the feed apparatus 4 and the extractor apparatus 7, the fleece is guided between a needling table 24 situated on the side opposite the apparatuses 2 and 3, and a stripper plate 26 situated on the side adjacent to the needling apparatuses 2 and 3, which are therefore both on the same side of the path 1. However, it is possible to provide an additional needling apparatus on the same side as the table 24 (therefore under the table 24), or even two additional apparatuses which can also form an assembly according to the invention, for example an assembly which is the mirror image of that shown, with respect to the plane 1 of the path of the fleece.

Each of the needling apparatuses 2 and 3 comprises a movable structure 36 (see FIG. 2), itself comprising a mobile rod 38. A support 44 is fixed to the proximal end of the rod 38, and a needle bar 46 is interchangeably secured to the support 44, on the face thereof which faces away from the rod 38. The bar 46 carries needling needles 47 directed towards the fleece 41 and capable of cyclically penetrating through the fleece 41 via orifices provided in the stripper plate 26, said orifices diagrammatically shown by a large opening in FIG. 2. In maximum-penetration position, the tip of the needles 47 projects into orifices in the table 24, which are also diagrammatically shown by a large opening in FIG. 2. In reality, the support 44 is fixed to several rods 38 aligned in a direction perpendicular to the plane of FIGS. 1 and 2.

The structure 36 is both movable in a reciprocating movement along a penetration direction transverse to the plane of the path 1 of the fleece 41, and oscillating about an oscillation axis 37 integral with the frame 19 of the machine in order to impart to the needles 47 a "progressive" movement component, essentially parallel to the direction 6 of progression of the fleece. Each sliding rod 38 is mounted to slide along its longitudinal axis 42 in a respective guide 39 which is itself pivotably supported in the frame 19 about the oscillation axis 37 which is parallel to the width of the fibre fleece. The axis 37 intersects the longitudinal axis 42 of the sliding rod 38. By means which will be described below, the longitudinal axis 42 oscillates about the oscillation axis 37 on either side of a general axis 43 intersecting the axis 37 and perpendicular to the plane of the path 1.

There is accordingly between the needles 47 and the frame 19 of the machine, a kinematic linkage comprising a sliding which is mechanically in series with an articulation. In this example, starting from the needles 47, there is first the sliding of the rod 38 in the guide 39, then the rotation of the guide 39 in the frame 19.

The kinematic linkage in question means that there is between the needles and the frame of the machine a mechanical part, in this case the guide 39, which is rotatably guided relative to one of the two elements, here the frame, and slidingly guided relative to the other element, here the needles. This kinematic linkage has no actuating function.

Moreover, in this embodiment, the sliding guide surface of the guide 39 is situated inside its cylindrical surface 40 of articulation to the frame. Thus, the two guide means are extremely close to each other, and the accumulated plays are as small as possible, the guiding of the movable structure 36 relative to the frame being almost as precise and robust as a simple and single articulation.

The needling apparatus 2 or 3 also comprises an actuating mechanism which is independent of but supplements the above-mentioned guide means. The actuating mechanism comprises two eccentric shafts 48*a*, 48*b* supported in rotation by the frame 19 about axes 49*a*, 49*b* parallel to the oscillation axis 37 and situated symmetrically on either side of the general axis 43. The actuating mechanism furthermore comprises two connecting rods 51*a*, 51*b*, the big end 52*a*, 52*b* of which is articulated to a respective eccentric journal 53*a*, 53*b* of the eccentric shafts 48*a*, 48*b*. The small end 54*a*, 54*b* of each connecting rod 51*a*, 51*b* is articulated, about a respective positioning axis 56*a*, 56*b*, to the oscillating-sliding rod 38. The positioning axes 56*a*, 56*b* are adjacent to the distal end of the rod 38. Along the axis 42 of the rod 38, the sliding guide 39 is situated between the support 44 and the centre-distance line 56*c* of the positioning axes 56*a* and 56*b*.

The arrangement is such that the two connecting-rod small ends 54*a*, 54*b* point obliquely towards each other, and away from the path 1 of the fleece. The two positioning axes 56*a*, 56*b* are arranged symmetrically relative to the axis 42 of the oscillating-sliding rod 38 and relatively very close to each other. The eccentricity radii 61*a*, 61*b* of the connecting-rod big-end axes have the same length, and the length of the connecting rods 51*a*, 51*b*, measured as the distance between the connecting-rod big-end axis and the connecting-rod small-end axis is the same.

The two eccentric shafts 48*a*, 48*b* are driven in opposite rotational directions and at the same rotation speed, as indicated by arrows 57*a*, 57*b*, for example by means of mutually meshing toothed wheels 58*a*, 58*b* (FIG. 2), each turning with a respective one of the shafts 48*a*, 48*b*. In the example shown, the arrangement and the rotation directions 57*a*, 57*b* are such that when the eccentric journals 53*a*, 53*b* carry out the part of their motion directed towards the plane of the path 1 of the fleece, the connecting rods 51*a*, 51*b* operate in traction and are substantially perpendicular to the plane of the fleece. They thus very efficiently transmit their force for the penetration of the needles 47 into the fleece 41. During the lift phase, illustrated in FIG. 2, the connecting rods 51*a*, 51*b* are much more oblique, they operate in compression and in a less favourable orientation, but the effort to be provided is less. Overall, the distribution of efforts over a cycle is optimized, which makes it possible to lighten the mechanism, and therefore the inertia forces and vibrations, which further increases the possible lightening.

The mechanism comprises means for shifting the phase of the shaft 48*b* relative to the shaft 48*a*. These means are diagrammatically shown in FIG. 2 by an adjustment 59 of the angular position of the shaft 48*b* relative to the gear 58*b* which drives shaft 48*b* in rotation about its axis 49*b*. In practice, the adjustment can take the form of a clutch the two discs of which have, on their mutual contact surfaces, teeth which fit into each other while the clutch is engaged. These teeth have a pitch of angular degree order. There is also a brake on the eccentric shaft 48*b*, and an angle encoder on each of the two eccentric shafts 48*a*, 48*b*. In order to carry out an adjustment, the apparatus being stationary, the brake is applied, the clutch is disengaged and the drive motor is turned until the angle encoders indicate that the desired phase-shift is achieved. The clutch is re-engaged, then the brake is released.

The adjustment of the phase-shift angle between the radii 61*a* and 61*b* allows adjustment of the length of the progression component (parallel to the direction of progression of the fleece 41) of the movement of the needles 47.

If the phase shift between the radii 61*a*, 61*b* is adjusted so that the two eccentricity radii 61*a*, 61*b* are arranged symmetrically relative to the general axis 43, then the needling takes place strictly along the axis 43, i.e. the axes 42 and 43 coincide for all the angular positions of the eccentric shafts 48*a*, 48*b*. In fact, in every angular position of the shafts 48*a* and 48*b*, the polygon defined by the axes 37, 49*a*, axis of 53*a*, 56*a*, 56*b*, axis of 53*b* and 49*b* has a mirror symmetry relative to the axis 43. The movement obtained for the needles 47 is a movement analogous to that of a simple crank connecting-rod system, but with two exceptions:

- thanks to the reversal of the connecting rods 51*a*, 51*b*, i.e. with the connecting-rod small ends 56*a*, 56*b* in distal position, that of the two dead centres (reversal points of the direction of movement of the rod 38) for which the absolute acceleration value is lowest is that corresponding to the maximum-penetration position of the needles 47 in the fleece 41;
- thanks to the use of two connecting rods and two eccentrics, this effect of smoothness of the change of direction at the maximum-penetration point is further increased.

Figure 2:
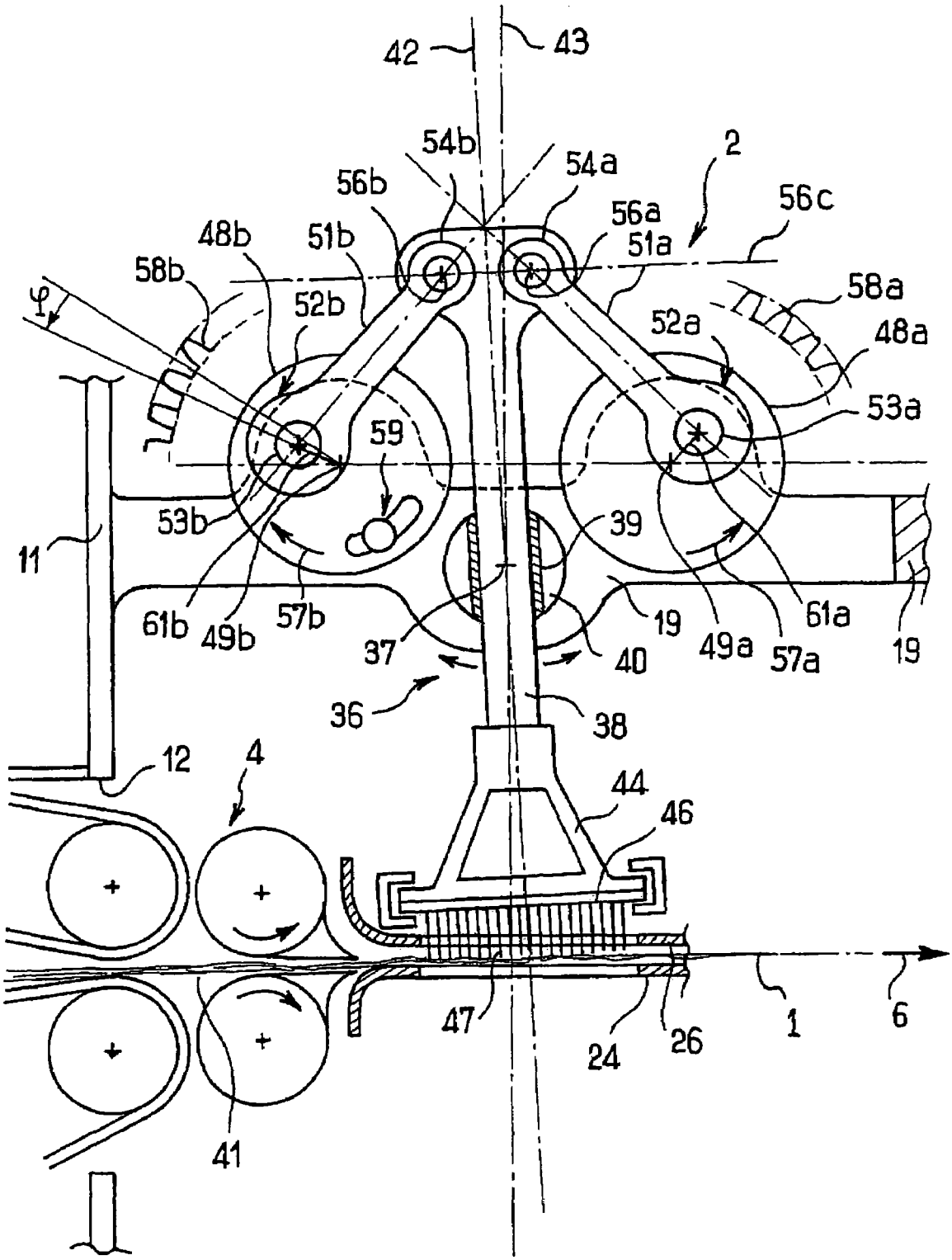
FIG. 2 is a more detailed view of one of the needling apparatuses according to FIG. 1, in an operating phase when passing from the maximum-penetration position to the maximum-withdrawal position.

In practice, as shown more precisely in FIG. 2, the adjustment device 59 is adjusted so that the eccentric shaft 48*b* situated to the rear relative to the direction 6 of progression of the fleece lags in its rotation relative to the shaft 48*a* situated to the front, i.e. the shaft 48*b* lags by a certain angle $\phi$ relative to the position where it would be symmetrical with the shaft 48*a* relative to the general axis 43.

This has three consequences:

- When the rod 38 moves away from the fleece 41 (FIG. 2), the connecting rod 51*a* situated ahead is at the same time more distal than the other connecting rod 51*b*, whereby the distal end of the rod 38 is displaced towards the rear; consequently the proximal end of the rod 38 is shifted towards the front, and the set of needles 47 is itself shifted in the direction 6 relative to the axis 43, as shown in FIG. 2;
- During the drop phase, this is reversed, the connecting rod 51*a* ahead of the other is more proximal and keeps the proximal end of the rod 38 in a position tilted towards the rear;
- The movement 91*a* (FIG. 1) of the needles 47 towards the front occurs in the vicinity of the maximum-penetration position in the fleece (apparatus 2 in FIG. 1), where the reversal of the direction of the vertical component of movement takes place with accelerations that are further reduced due to the non-coincidence of the dead centres of the two crank connecting-rod systems, and the tilting 91*b* from the front towards the rear takes place in the vicinity of the maximum-withdrawal position of the needles 47 (apparatus 3 in FIG. 1).

According to the invention, as illustrated in FIG. 1, the two—substantially identical—apparatuses 2 and 3, are actuated at the same strike rate but with their actuating mechanisms having a 180° phase shift between them. Thus, when the movable structure of one of the apparatuses carries out its progressive movement by which the needles 47 accompany the fleece in the direction 6 (arrow 91*a* in FIG. 1), the movable structure of the other apparatus carries out a movement in the opposite direction (arrow 91*b* in FIG. 1) and the inertia forces produced by the reciprocating movement of the movable structures of these two apparatuses parallel to the direction 6 of progression of the fleece are mutually balanced.

The two apparatuses 2 and 3 are preferably aligned on the same side of the fleece so that, in spite of the complex tilting movement of the two movable structures, there is in practice an elementary balancing in each theoretical plane parallel to the plane 1 of the fleece.

The two apparatuses also balance in vertical direction, but less perfectly, as this balancing takes place in directions 43 which are spaced apart from each other, therefore with the appearance of a vibratory torque. But counterweights on the eccentric shafts 48*a*, 48*b* of the crank connecting-rod systems can reduce the vertical vibrations of each apparatus.

The two apparatuses in phase opposition also have the effect of accompanying in turn the movement of the fleece in the direction 6 through the needling an installation.

In order to drive the two actuating mechanisms at the same rate and with a phase shift of 180°, they can be connected to each other by an appropriate mechanical link, permanent or not, adjustable or not, or each mechanism can also be driven by a servomotor, the two servomotors being linked to a common control unit which regulates their respective speeds and their mutual phase shift, for example according to U.S. Pat. No. 5,636,420.

Figure 3:
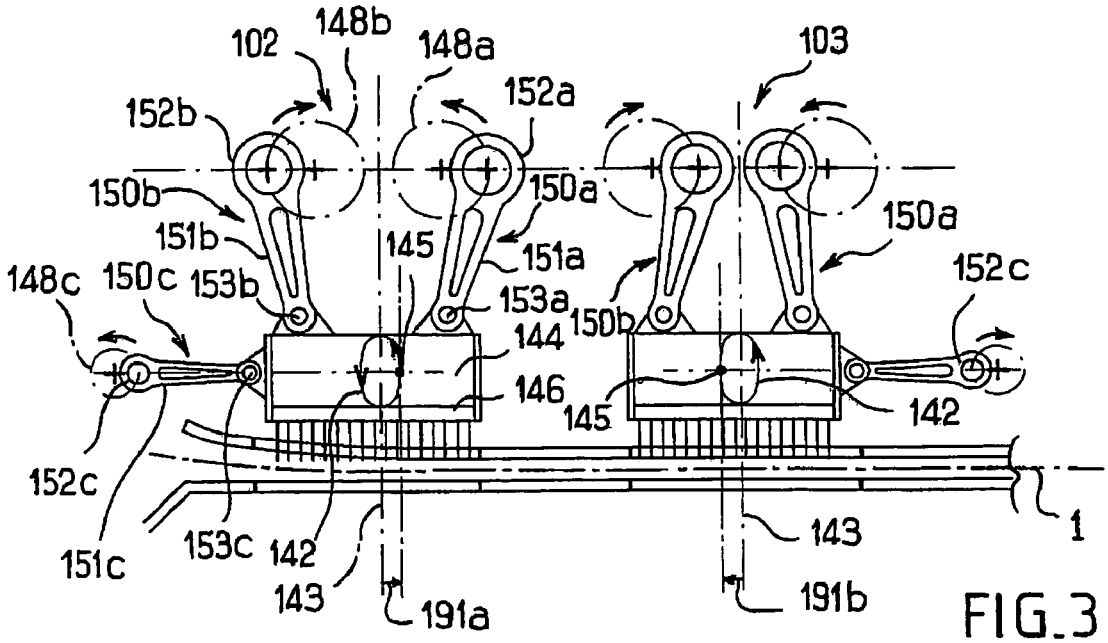
FIG. 3 is a diagrammatic view of another embodiment of a needling installation implementing the method.

In the example shown in FIG. 3, in each mechanism 102, 103, the support 144 of the needle bar 146 is suspended and articulated to two crank connecting-rod systems 150*a*, 150*b*. The big ends 152*a*, 152*b* of the two connecting rods 151*a*, 151*b* of these two systems are each articulated in eccentric manner to a respective eccentric shaft 148*a*, 148*b*, which is symbolized only by a dot-dash circle. The small ends 153*a*, 153*b* of the two connecting rods are articulated to the support 144. The two eccentric shafts are symmetrical to each other and turn at the same speed in opposite directions. They could turn in the same direction. What is important is that the two connecting-rod big ends are always at substantially the same level, or more generally at the same distance from the path 1 of the fleece in order to impart to the needle bar 146 the vertical component, or penetration component, of its elliptical movement illustrated by an ellipse 142 travelled by the transverse axis 145 of the support 144.

The axes of the two connecting-rod small ends and of the two connecting-rod big ends together form a trapezium which, by itself, would be deformable (the needle bar could rock from the front to the rear). However, the configuration of the trapezium is defined by a third crank connecting-rod system 150*c* generally oriented substantially parallel to the direction of progression of the fleece. This system 150*c* comprises a connecting rod 151*c* the big end 152*c* of which is articulated in eccentric position to an eccentric shaft 148*c*. The small end 153*c* of the connecting rod 151*c* is articulated to the support 144. The system 150*c* essentially gives the needle bar 146 the progression component (typically horizontal) of its elliptical movement illustrated by the ellipse 142.

In the example, the two systems 150*c*, one forming part of the mechanism 102 and the other forming part of the mechanism 103 are respectively placed upstream of the upstream mechanism 102 and downstream of the downstream mechanism 103. They could be placed both upstream or both downstream. Their eccentric shafts turn in opposite directions, but could turn in the same direction. What is important is above all that the two connecting-rod big ends 152*c* are at each time-point in positions defining for the two needle bars 146 two substantially equal and opposite horizontal deviations 191*a* and 191*b* relative to the mean vertical axis 143 of their movement illustrated by the ellipse 142. Moreover, the two crank connecting-rod systems 150*b*, 150*a* of the mechanism 102 are substantially in phase opposition, in other words angularly displaced overall by 180° measured on the eccentric shaft 148*a*, 148*b*, relative to the two crank connecting-rod systems 150*a*, 150*b* of the mechanism 103, such that the needle bar 146 linked to the mechanism 102 is in withdrawal movement when that linked to the mechanism 103 is in penetration movement, and vice-versa.

Overall, the two axes 145 are always in substantially diametrically opposite positions on their respective elliptical trajectories, which they travel in the same rotation direction.

Figure 4:
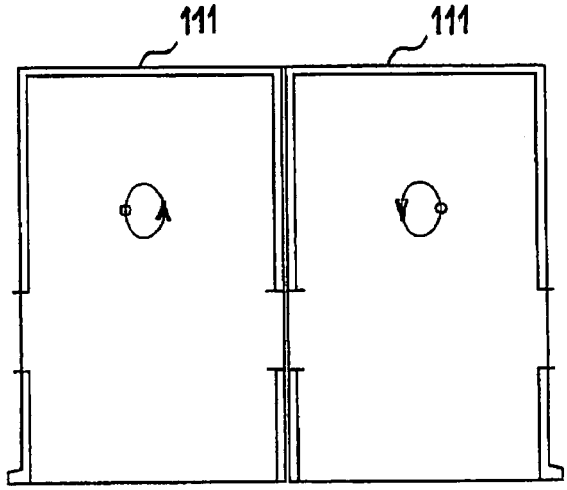
FIGS. 4 and 5 are two diagrams of frames for needling installations implementing the method according to the invention.

In the embodiment of FIG. 4, instead of being mounted in a common frame, the two successive needling apparatuses, whether they are according to FIGS. 1 and 2, or according to FIG. 3, are arranged in two frames 111 which are separate but fixed to each other sufficiently rigidly for the horizontal vibrations of the one to be balanced by the horizontal vibrations of the other by means of the respective angular phases of the two mechanisms, according to the invention.

Figure 5:
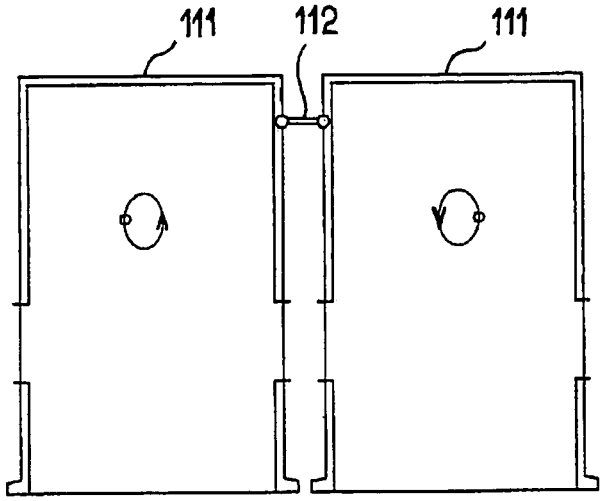

In the embodiment of FIG. 5, the two frames 111, instead of being adjacent and directly fixed to each other, are connected to each other by means of reaction bars 112 (only one is shown) which can be articulated or rigidly secured to each of the frames 111. The bars 112 are mounted and/or orientated in order to transmit efforts from one frame to the other in the direction of progression of the fleece.

The invention is not limited to the examples described and is of benefit in any "elliptical" needling installation, whatever the method of guiding and actuating the needles.

In the particular embodiment shown in FIGS. 1 and 2, the positioning axes 56*a* and 56*b* could be merged.

The invention is also applicable to needling by two successive apparatuses needling from the lower face of the fleece, combined or not with needling from the upper face as shown. The lower needling means can operate with a strike simultaneous with the upper needling means, or with a strike alternating with the latter. With a simultaneous strike, the top and bottom needles are in penetration position together. With an alternating strike, the top needles are in withdrawal phase when the bottom needles are in penetration phase, and vice-versa.

The invention claimed is:

1. A method for needling a fibre fleece in at least two successive needling apparatuses each comprising a movable structure carrying needles and to which a movement is imparted having, in the needles, a reciprocating component of penetration into the fleece and a reciprocating progression component, wherein the two needling apparatuses are actuated with a first phase shift between them such that the reciprocating progression components of the two movable structures are substantially in opposite directions, and a second phase shift such that the reciprocating penetration components of the two movable structures are substantially in opposite directions.

2. A method according to claim 1, wherein in each needling apparatus the progression component is generated by angular oscillation of the movable structure about an axis which is substantially parallel to the width of the fleece.

3. A method according to claim 1, wherein the phase shift is substantially 180°.

4. A method according to claim 1, wherein in the movement, the needles follow a ring path which is substantially in the same direction of a movement of the fleece when the needles are engaged therein, and substantially in an opposite direction when they are disengaged.

5. A needling installation comprising two needling apparatuses which succeed one another along a path of a fibre fleece to be needled which each comprise a movable structure intended to carry needles and an actuating mechanism applying to the movable structure a movement having in the needles a reciprocating penetration component and a reciprocating progression component wherein the two actuating mechanisms are capable of an identical rate with a first phase shift between them such that the reciprocating progression components of the two movable structures are substantially in opposite directions, and a second phase shift such that the reciprocating penetration components of the two movable structures are substantially in opposite directions.

6. An installation according to claim 5, wherein the two apparatuses are substantially identical.

7. An installation according to claim 5, wherein the movable structures of the two apparatuses are substantially aligned in the direction of progression of the fleece, on a same side of the fleece.

8. An installation according to claim 5, wherein the first phase shift is substantially 180°.

9. An installation according to claim 5, wherein in each apparatus, the progression component is at least partially generated by angular oscillation of the movable structure.

10. An installation according to claim 9, wherein the movable structure is guided relative to a frame of the installation by a functional chain comprising a sliding in series with an articulation about an oscillation axis parallel to a width of the fibre fleece.

11. An installation according to claim 10, wherein the sliding and the articulation are carried out by means such that a sliding means are situated inside an articulation means.

12. An installation according to claim 10, wherein the movable structure is slidingly guided in a guide mounted for oscillation in said articulation.

13. An installation according to claim 10, wherein the actuating mechanism comprises two crank connecting-rod systems, each system comprising a connecting rod a small end of which is articulated to said movable structure about a positioning axis parallel to said oscillation axis.

14. An installation according to claim 13, wherein the guide is placed substantially between two eccentric means turning in opposite directions to each other and each forming part of a respective one of the two crank connecting-rod systems.

15. An installation according to claim 13, wherein the two crank connecting-rod systems are essentially identical and capable of phase-shifting, one being situated ahead of and the other behind the positioning axis, relative to the direction of travel of the fleece.

16. An installation according to claim 13, wherein there is a respective positioning axis for each of the two crank connecting-rod systems.

17. An installation according to claim 16, wherein the two positioning axes are side-by-side to each other.

18. An installation according to claim 13, wherein the two connecting rods are orientated with their connecting-rod small end pointing in a direction generally away from the plane of the fleece.

19. An installation according to claim 5, wherein the two needling apparatuses are mounted in a common frame.

20. An installation according to claim 5, wherein the two needling apparatuses are each mounted in a frame, the two frames being secured to each other.

21. An installation according to claim 5, wherein the two needling apparatuses are each mounted in a frame, the two frames being linked to each other by at least one reaction bar.

22. An installation according to claim 10, wherein the actuating mechanism comprises two crank connecting-rod systems, each system comprising a connecting rod a small end of which is articulated to said movable structure about a positioning axis parallel to said oscillation axis.

23. The installation according to claim 5, wherein in the movement, the needles follow a path ring which is substantially in the same direction of a movement of the fleece when the needles are engaged therein, and substantially in an opposite direction when they are disengaged.

* * * * *